US005417423A

United States Patent [19]

Oursler et al.

[11] Patent Number: 5,417,423

[45] Date of Patent: May 23, 1995

[54] MULTIPLE KICKER RAMP FOR A PINBALL GAME

[75] Inventors: Barry S. Oursler, Barrington; Zofia Bil, Chicago, both of Ill.

[73] Assignee: Williams Electronics Games, Inc., Chicago, Ill.

[21] Appl. No.: 238,231

[22] Filed: May 4, 1994

[51] Int. Cl.[6] ..... A63F 7/30; A63F 7/38

[52] U.S. Cl. ..... 273/127 R; 273/121 A; 273/119 A; 273/127 C

[58] Field of Search ..... 273/118, 119, 121, 127 R, 273/129 R, 7

[56] References Cited

U.S. PATENT DOCUMENTS 4,861,037 8/1989 Oursler .

5,120,058 6/1982 Trudeau et al. .

5,333,866 8/1994 Tanger et al. ..... 273/119 A X

*Primary Examiner*—Raleigh W. Chiu

*Attorney, Agent, or Firm*—Rockey, Rifkin and Ryther

[57] ABSTRACT

The play feature for a game of the present invention comprises a multiple kicker ramp including a plurality of spaced-apart longitudinal dividers which define parallel ball lanes and a plurality of perpendicular paths between the ball lanes. Balls enter the ramp from the playfield. A ball sensor is provided in each of the perpendicular paths, each sensor associated with a different point value. A multiple kicker element, which is activated by a player controlled switch, is provided in one of the ball lanes to direct a ball to the other ball lane over one of the perpendicular paths to activate its ball sensor. This causes the point value of the activated sensor to be added to the player's score.

7 Claims, 2 Drawing Sheets

MULTIPLE KICKER RAMP FOR A PINBALL GAME

BACKGROUND OF THE INVENTION

This invention relates to pinball games and more particularly to play features used in pinball games which are designed to foster and to maintain player interest in the games. A typical pinball game includes an inclined playfield which supports a rolling ball, a pair of player controlled flippers, a vertical backbox housing the game electronics and a variety of play features (electromechanical devices) on the playfield. The person who plays the game controls the flippers mounted on the playfield to keep the pinball in play.

A typical object of pinball games is for the player to direct pinballs at selected play features or targets on the playfield to score points or to achieve some predetermined game objective. Player interest in pinball games is increased by providing novel play features which allow a player to increase the score by directing a pinball at the play feature by a skill shot. It is desirable for pinball game manufacturers to design play features which provide entertaining effects and which stimulate player interest in the game by allowing for increased scores.

SUMMARY OF THE INVENTION

The play feature for a pinball game of the present invention comprises a multiple kicker ramp. Balls enter the ramp from the playfield. The ramp includes a plurality of spaced-apart longitudinal dividers which define parallel ball lanes and a plurality of perpendicular paths between the ball lanes. A ball sensor is provided in each of the perpendicular paths, each sensor associated with a different point value. A multiple kicker element, which is activated by a player controlled switch, is provided in one of the ball lanes to direct a ball to the other ball lane via one of the perpendicular paths thereby to activate its ball sensor. This causes the point value of the activated sensor to be added to the player's score.

DETAILED DESCRIPTION OF A PREFERRED EMBODIMENT

Figure 1:
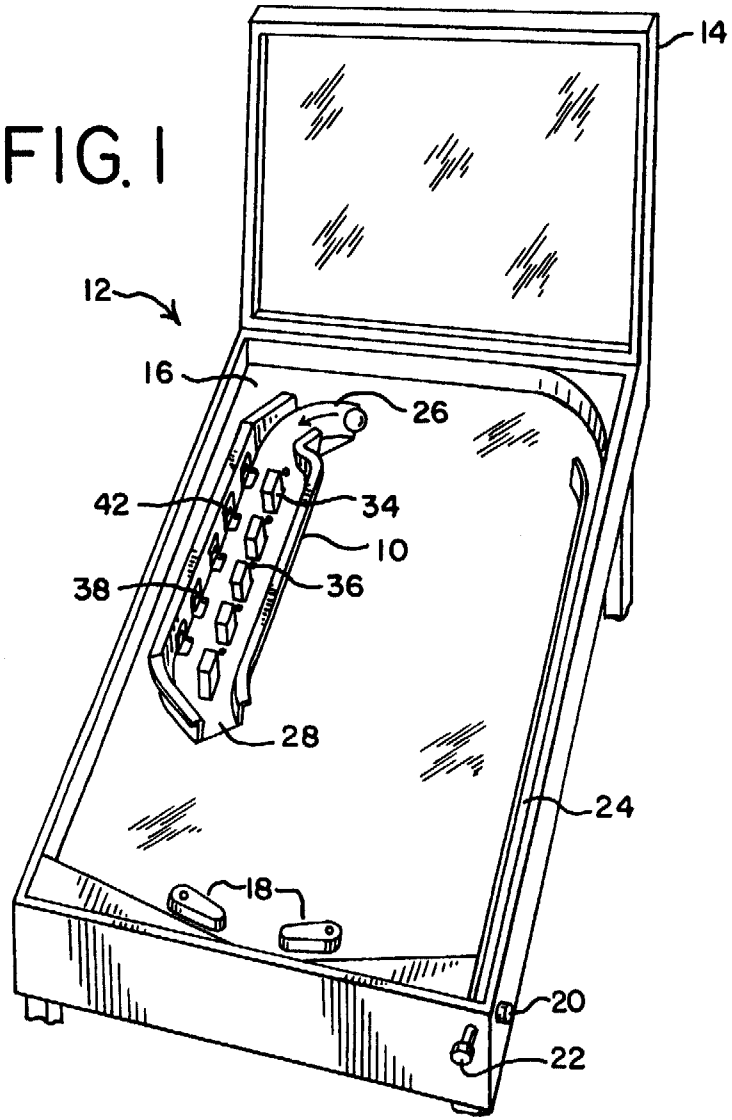
FIG. 1 is a perspective view of a pinball game which includes the multiple kicker ramp according to the present invention.

Referring to FIG. 1, the multiple kicker ramp 10 mounted on a pinball game playfield is illustrated. A typical pinball game 12 includes a vertical backbox 14, an inclined playfield 16, a pair of flippers 18, flipper control switches 20, a shooter 22 (or similar device) and shooter lane 24 (for introducing a ball onto the playfield) and a pinball which rolls about on the playfield 16. In practice, playfield 16 incorporates a number of other playfield features, the multiple kicker ramp 10 being the only feature shown for clarity.

Figure 2:
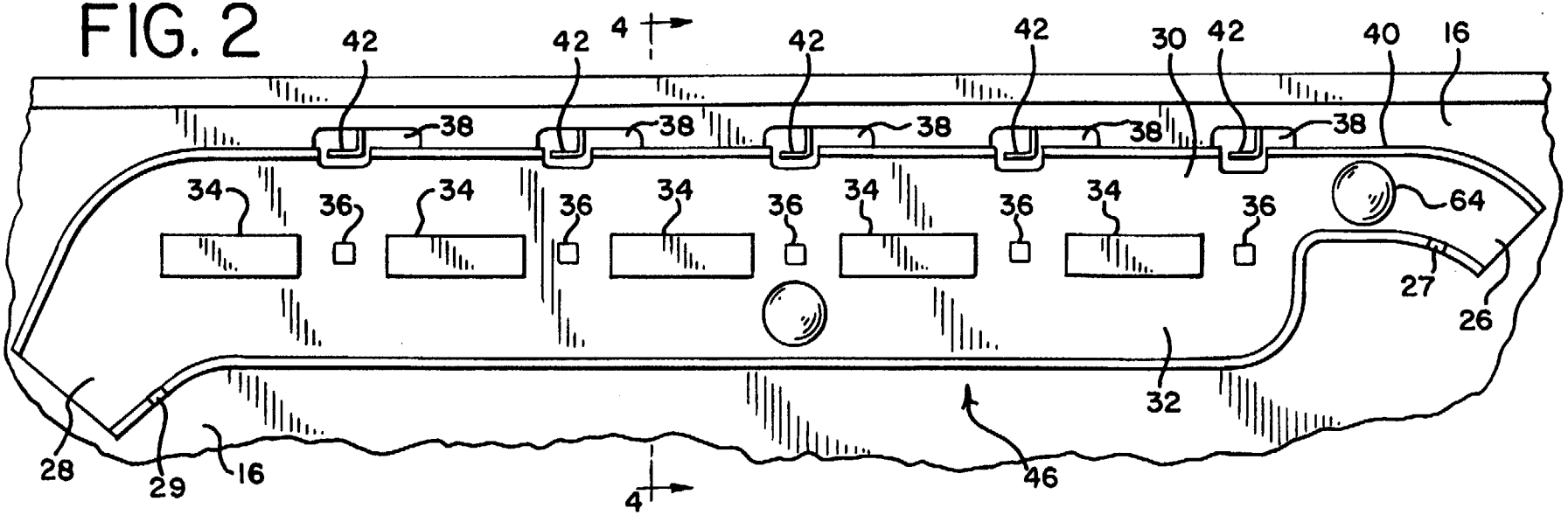
FIG. 2 is a plan view of the multiple kicker ramp of FIG. 1.

Referring to FIG. 2, a plan view of the multiple kicker ramp 10 is illustrated. A pinball can be directed into entrance 26 by a skill shot using the flippers 18, by ricochet off of a thumper bumper, or by being transported there by a different play feature (not shown) as, for example, a wireform ball guide. Ramp 10 is mounted on playfield 16 such that a ball located at entrance 26 will roll thereon due to gravity, the ramp including an exit 28 which allows balls to be returned to playfield 16.

Figure 4:
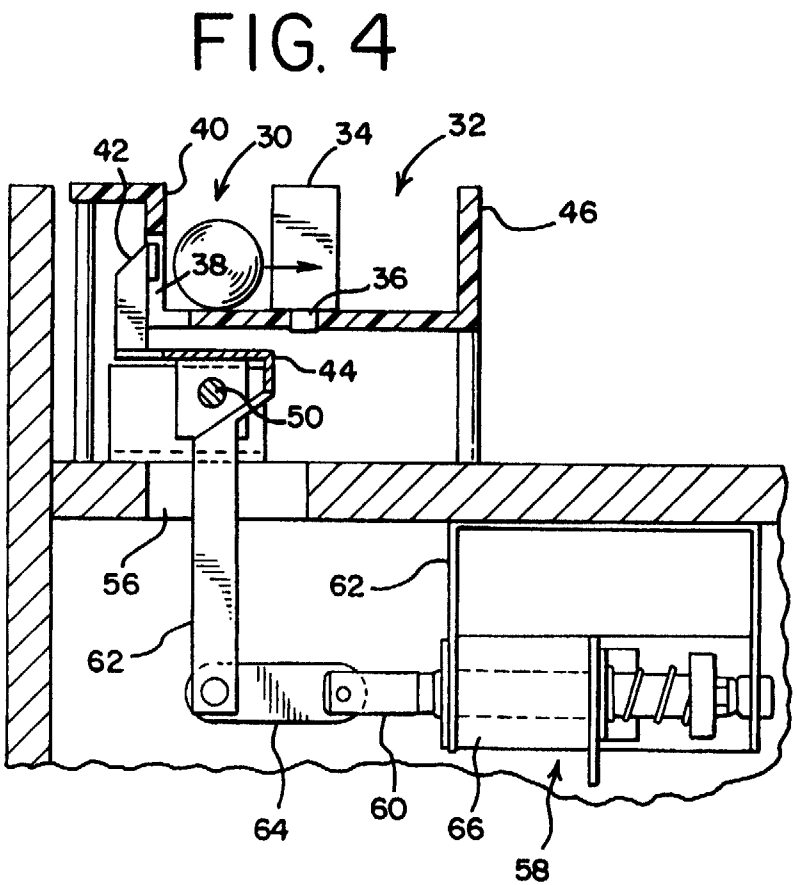
FIG. 4 is a cross-sectional view of the multiple kicker ramp taken along lines 4—4 of FIG. 2.

Multiple kicker ramp 10 is preferably formed of molded plastic and is divided into a first lane 30 and a scoring lane 32 by a plurality of dividers 34 disposed along the ramp's longitudinal axis. Interposed between each divider 34 are a plurality of sensors 36, each of which is associated with a different point value and is activated when a pinball travels from lane 30 to lane 32 past one of sensors 36. A plurality of apertures or cut-outs 38 are provided in sidewall 40 (FIG. 4) in line with the sensors 36. Each cut-out 38 is shaped to receive a kicker element 42 as illustrated in FIG. 3.

A ball sensor 27 is provided at entrance 26 to detect the entrance of a pinball. When sensor 27 is activated, the game microprocessor permits the solenoid 58 (shown in FIG. 4) to be controlled by a player operated switch such as flipper switches 20. Sensor 29 is provided at exit 28 to detect the return of a pinball to playfield 16 from ramp 10. When sensor 29 is activated by the close proximity of a pinball, the game microprocessor deactivates control of solenoid 58. Sensors 27, 29 and 36 preferably are eddy current sensors which detect the presence of a pinball due to changes in the magnetic field caused by the ferromagnetic ball, but they could also be roll-over or optical type switches.

Figure 3:
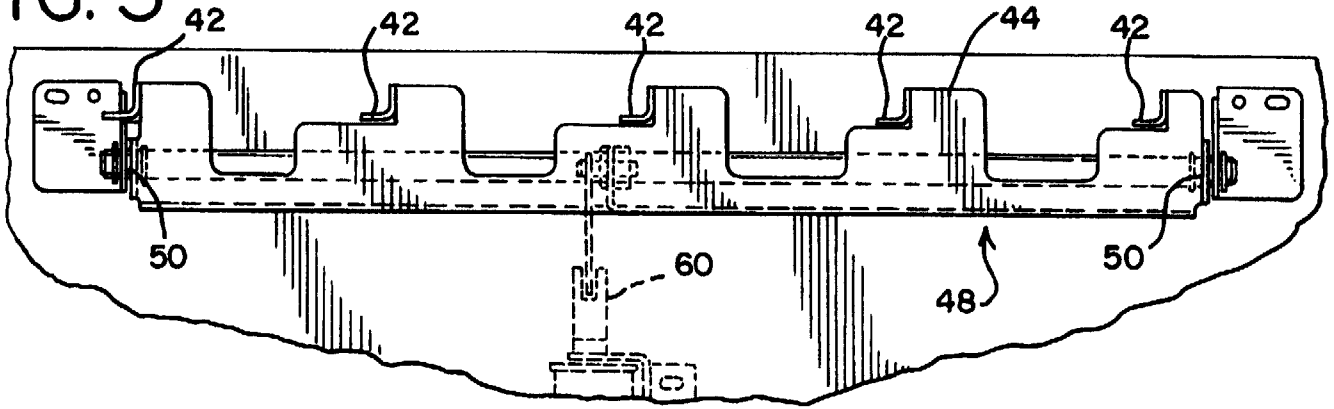
FIG. 3 is a top view of the kicker bracket assembly with the ramp removed.

Referring to FIG. 3, a top view of the rotating kicker bracket assembly is illustrated. Each of the individual kickers 42 is secured to a kicker bracket 44. Bracket 44 is connected to the plunger 60 (FIG. 4) of solenoid 58 via pivot arm 62 and link 64 while solenoid 58 is attached to playfield 16 by mounting bracket 60. As understood by those skilled in the art, the kickers 42 and bracket 44 are pivoted about a rod 50 as a function of the operation of solenoid 58.

Initially, a player directs a ball at the entrance 26 of the multiple kicker ramp, as the ball drawn at location 88 in FIG. 2 illustrates. The presence of a ball activates sensor 27 which allows the game player to energize solenoid 58 by activating a control switch such as flipper button 20.

If the player takes no action, the ball will roll down lane 30 to exit 28 and return to the playfield 16. In such a case, no points are scored. If a player activates the flipper control switch when a ball is located in first lane 30, solenoid 58 is energized to operate all of the kicker elements 42 in an attempt to "kick" the ball from lane 30 to lane 32. If the ball is successfully kicked, it will activate one of the sensors 36 causing it to generate a signal which is sent to the game microprocessor. The player can repeatedly active the control switches to attempt to kick a ball as long as a ball is on the ramp.

Each of the sensors 36 is associated with different point values. Thus, the object of the multiple kicker ramp is for the player to kick a pinball to cause the ball to activate the sensor 36 associated with the maximum point value. The game player accomplishes this by activating the control switch when a pinball is disposed in lane 30 adjacent the pair of dividers 34 between which the maximum point value sensor 36 is disposed.

Activation of this sensor generates a signal sent to the game microprocessor to add the maximum point value to the player's score. Thereafter, the ball is returned to playfield 16 via lane 32 and exit 28 which activates sensor 29 to deactivate solenoid 58. Activation of any of the other sensors 36 causes the game microprocessor to add lower award levels of less than maximum points.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A play feature for a pinball game having an inclined playfield supporting a rolling ball thereon comprising:

a ramp having a plurality of longitudinal dividers defining first and second lanes, each divider spaced from the other by a distance greater than the diameter of the rolling ball;

a plurality of ball sensors disposed to detect passage of a ball between said dividers and for generating a signal responsive thereto; and player controlled means for propelling a ball from the first lane, between a pair of said dividers, to the second lane to activate one of said sensors, whereby a point value associated with said activated sensor is awarded.

2. The play feature of claim 1 wherein said sensors are roll-over switches.

3. The play feature of claim 1 wherein said sensors are eddy-current sensors.

4. The play feature of claim 1 wherein said means for propelling includes a plurality of kickers disposed in operative relation to the spaces between the dividers.

5. The play feature of claim 4 wherein said means for propelling further comprises a player controlled solenoid for moving the kickers into the first lane to attempt to divert the ball into the second lane.

6. The play feature of claim 1 further comprising a microprocessor for adding the point value awarded to the player's score in response to said signal.

7. A play feature for a pinball game having an inclined playfield supporting a rolling ball thereon comprising:

a ramp having a plurality of longitudinal dividers defining first and second lanes, each divider spaced from the other by a distance greater than the diameter of a rolling ball;

a plurality of ball sensors disposed to detect passage of a ball between said dividers and for generating a signal responsive thereto; and player controlled means for propelling a ball from the first lane, between a pair of said dividers, to the second lane to activate one of said sensors; and a microprocessor for adding a point value associated with said activated sensor to the player's score in response to said signal, whereby maximum points are awarded when the player causes the sensor associated with the maximum point value to be activated.

* * * * *